US012644658B2

(12) United States Patent
Krupa

(10) Patent No.: US 12,644,658 B2
(45) Date of Patent: Jun. 2, 2026

(54) METAL ROTARY HEAT TRANSFER ASSEMBLY FOR A ROTARY AIR HEAT EXCHANGER

(71) Applicant: BŁAŻEJ KUBIAK LOSCAR, Raszków (PL)

(72) Inventor: Andrzej Krupa, Ostrow Wielkopolski (PL)

(73) Assignee: LOSCAR Spółka z ograniczon odpowiedzialności, Raszków (PL)

( * ) Notice: Subject to any disclaimer, the term of this patent is extended or adjusted under 35 U.S.C. 154(b) by 124 days.

(21) Appl. No.: 18/841,357

(22) PCT Filed: Feb. 23, 2023

(86) PCT No.: PCT/PL2023/050010
§ 371 (c)(1),
(2) Date: Aug. 23, 2024

(87) PCT Pub. No.: WO2023/163607
PCT Pub. Date: Aug. 31, 2023

(65) Prior Publication Data

US 2025/0172354 A1 May 29, 2025

(30) Foreign Application Priority Data

Feb. 24, 2022 (PL) ..... 440466

(51) Int. Cl.
*F28F 5/02* (2006.01)

(52) U.S. Cl.
CPC ..... *F28F 5/02* (2013.01)

(58) Field of Classification Search
CPC ..... F28F 5/02; F28F 2215/08; F28D 19/042; F28D 19/044
See application file for complete search history.

(56) References Cited

U.S. PATENT DOCUMENTS 3,384,157 A * 5/1968 Vonk ..... F28D 19/042 165/10
3,958,626 A * 5/1976 Klein ..... F28D 19/042 428/592

(Continued)

*Primary Examiner* — Travis Ruby
(74) *Attorney, Agent, or Firm* — Ware, Fressola, Maguire & Barber LLP

(57) ABSTRACT

The invention relates to a metal rotary heat transfer assembly (1) for a rotary air heat exchanger comprising a corrugated metal strip (2) and a metal support flat strip (3) wound spirally in the circumferential direction and alternately in the radial direction on a central element (4), wherein the corrugated metal strip (2) is corrugated in the circumferential direction, and wherein in a cross-section made in a plane perpendicular to the longitudinal axis (01) of the assembly (1) said corrugated metal belt (2) comprises a set of corrugation leg portions (21) interconnected alternately by corrugation crest portions (22) and corrugation trough portions (23), and wherein a plurality of transverse through channels (5) passing through said metal rotary heat transfer assembly (1) in the direction of its longitudinal axis (01) is defined between the corrugated metal strip (2) and the metal support flat strip (3), characterized in that, louvers (24) are formed in the corrugation leg portions (21) of the corrugated metal strip (2), and the louvers (24) comprise a series of pairs (25) of flaps (26) cut in the surfaces of the corrugation leg portions (21) and defining a series of connecting holes (27) in the corrugation leg portions (21), wherein in each flap (26) pair (25) the flaps (26) are bent relative to the corrugation leg portion (21) on opposite sides of the corrugation leg portion (21) and oriented oppositely relative to each other in the circumferential direction.

15 Claims, 8 Drawing Sheets

(56) References Cited

U.S. PATENT DOCUMENTS

| | | | | | |
|---|---|---|---|---|---|
| 4,136,729 | A * | 1/1979 | Sakaki | F28D 19/042 | 165/10 |
| 4,172,164 | A * | 10/1979 | Meyer | B32B 3/28 | 428/184 |
| 4,228,847 | A * | 10/1980 | Lindahl | F28D 19/042 | 156/200 |
| 4,255,171 | A * | 3/1981 | Dravnieks | F24F 3/1423 | 428/184 |
| 4,542,782 | A * | 9/1985 | Berner | F28D 19/042 | 165/8 |
| 4,729,428 | A * | 3/1988 | Yasutake | F28F 13/12 | 165/166 |
| 4,769,053 | A * | 9/1988 | Fischer, Jr. | B01D 53/261 | 96/144 |
| 4,911,227 | A * | 3/1990 | Saito | F28D 19/042 | 165/905 |
| 5,513,695 | A * | 5/1996 | Harting | F28D 19/044 | 165/8 |
| 6,179,276 | B1 * | 1/2001 | Chen | F28D 19/044 | 165/DIG. 42 |
| 6,450,245 | B1 * | 9/2002 | Chen | F28D 19/044 | 165/8 |
| 7,841,390 | B1 * | 11/2010 | Kaser | F28D 19/042 | 165/4 |
| 2006/0283581 | A1 * | 12/2006 | Lee | F28F 17/005 | 165/152 |
| 2008/0179048 | A1 * | 7/2008 | Yaezawa | B21D 31/046 | 72/185 |
| 2022/0074679 | A1 * | 3/2022 | Gao | F28F 1/128 | |
| 2022/0128320 | A1 * | 4/2022 | Joardar | F28F 1/128 | |
| 2025/0257949 | A1 * | 8/2025 | Onaka | F28F 1/105 | |

* cited by examiner

METAL ROTARY HEAT TRANSFER ASSEMBLY FOR A ROTARY AIR HEAT EXCHANGER

The present invention relates to a metal rotary heat transfer assembly for a rotary air heat exchanger comprising a corrugated metal strip and a metal support flat strip wound spirally in the circumferential direction and alternately in the radial direction on a central element, wherein the corrugated metal strip is corrugated in the circumferential direction, and wherein in a cross-section made in a plane perpendicular to the longitudinal axis of the assembly said corrugated metal belt comprises a set of corrugation leg portions interconnected alternately by corrugation crest portions and corrugation trough portions, and wherein a plurality of transverse through channels passing through said metal rotary heat transfer assembly in the direction of its longitudinal axis is defined between the corrugated metal strip and the metal support flat strip. Rotary air heat exchangers for which the metal rotary heat transfer assembly according to the present invention is intended, are used in particular for heat recovery in ventilation systems.

The above described metal rotary heat transfer assemblies are commonly known from the prior art, wherein in order to ensure technically rational heat transfer intensity, in these known solutions there are employed as low as possible heights of corrugation of the corrugated metal strips that do not exceed 3-4 mm, and transverse through channels of a small cross-section in order to obtain the largest possible volume of material of strips per an area unit of a frontal surface of such a heat transfer assembly.

This approach causes that known metal rotary heat transfer assemblies for a rotary air heat exchangers are featured by high material consumption and relatively high flow resistance for hot and cold air streams, and thus also a need to use fan systems with relatively high power and efficiency and relatively high operating costs of such fan systems required for ensuring appropriate flow rates of hot and cold air streams.

It has been the object of the present invention to provide a metal rotary heat transfer assembly for a rotary air heat exchanger having a construction which would feature both a reduced material consumption compared to solutions known from the prior art and a high efficiency of a heat transfer.

SUMMARY OF THE INVENTION

The invention provides a metal rotary heat transfer assembly for a rotary air heat exchanger comprising a corrugated metal strip and a metal support flat strip wound spirally in the circumferential direction and alternately in the radial direction on a central element, wherein the corrugated metal strip is corrugated in the circumferential direction, and wherein in a cross-section made in a plane perpendicular to the longitudinal axis of the assembly said corrugated metal belt comprises a set of corrugation leg portions interconnected alternately by corrugation crest portions and corrugation trough portions, and wherein a plurality of transverse through channels passing through said metal rotary heat transfer assembly in the direction of its longitudinal axis is defined between the corrugated metal strip and the metal support flat strip, as described at the outset, which characterized in that, louvers are formed in the corrugation leg portions of the corrugated metal strip, and the louvers comprise a series of pairs of flaps cut in the surfaces of the corrugation leg portions and defining a series of connecting holes in the corrugation leg portions, wherein in each flap pair the flaps are bent relative to the corrugation leg portion on opposite sides of the corrugation leg portion and oriented oppositely relative to each other in the circumferential direction.

The corrugated metal strip is preferably triangularly corrugated, or trapezoidally corrugated, or rectangularly corrugated or sinusoidally corrugated.

The flaps forming a pair of flaps are preferably coplanar with each other.

Deflection angles of a deflection relative to the surface of the corrugation leg portion for both flaps forming a pair of flaps are preferably the same.

The corrugation crest portion and the corrugation trough portion of the corrugated metal strip are preferably undetachably connected to the metal support flat strip in the contact areas with the metal support flat strip, preferably by means of an adhesive, and even more preferably they are soldered or glued to the metal support flat strip.

The corrugated metal strip and/or the metal support flat strip may be preferably covered with a layer of solder cladding, and/or is/are made of a composite metal sheet comprising at least two undetachably bonded layers of aluminum alloys, wherein radially outer layers of this sheet are made of alloys with lower melting points than the melting points of its inner layers.

The height of the corrugated metal strip amounts preferably at least 2 mm, and more preferably from 2 to 20 mm.

The corrugation pitch of the corrugated metal strip, corresponding to the distance between two adjacent corrugation crest portions or two adjacent corrugation trough portions, corresponding in turn to two adjacent corrugation leg portions, amounts preferably from 2 to 20 mm.

The thickness of the corrugated metal strip amounts preferably from 0.04 to 0.20 mm and/or the thickness of the metal support flat strip amounts preferably from 0.04 to 0.20 mm.

The flaps forming the louver are preferably connected to the corrugation leg portions along bending edges oriented nonparallel relative to the longitudinal axis of the rotary metal heat transfer assembly, and even more preferably they are oriented perpendicularly relative to the longitudinal axis of the rotary metal heat transfer assembly.

The pitch of the louver amounts preferably from 0.4 to 12 mm.

Deflection angle of the flaps of the louver amounts preferably from 1 to 65°.

The pairs of the flaps of the louvers are preferably grouped in subsets having a length constituting from 5 to 50% of the total length of the corrugated metal strip, wherein adjacent subsets are distanced from each other by a distance amounting preferably from 2 to 20 mm, and wherein the flaps of adjacent subsets which correspond to each other in the adjacent subsets have preferably opposite inclinations relative to the corrugation leg portions.

The metal support flat strip is preferably provided with louvers comprising a series of flaps.

The corrugated metal strip and/or the metal support flat strip have/has preferably micro-deformations, micro-corrugations, micro-projections and/or micro-roughness formed on surfaces thereof and preferably penetrating into the material of the strip to a depth amounting approximately 30% of the strip thickness The present invention is characterized by an increased intensity of heat transfer between an air stream and the material of the rotary heat transfer assembly, and an increased contact area between the corrugated metal strip and the metal support flat strip, thereby improving the intensity of a heat transfer between the components of the rotary heat transfer assembly.

The present invention provides improved rigidity to the entire rotary heat transfer assembly regardless of the temperature of the assembly.

The assembly process of the rotary heat transfer assembly of the present invention does not require the use of additional fasteners.

The construction of the present rotary heat transfer unit is simpler, more stable as it is a monolith after the manufacturing process, more economical and easier to transport, easier and faster to assemble than solutions known from the prior art; and furthermore the present invention provides much more efficient heat transfer.

BRIEF DESCRIPTION OF DRAWINGS

The invention shall be described and explained below in connection with the below presented embodiments and the attached drawings in which:

FIGS. 15-20 present axonometric views of some preferred types of metal sheets which the corrugated metal strips and metal support flat strips of the rotary metal heat transfer assembly according to the present invention may be made of.

DETAILED DESCRIPTION OF PREFERRED EMBODIMENT

Figure 2:
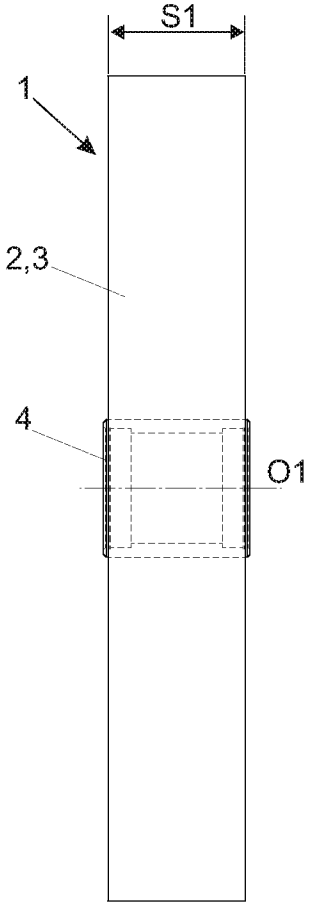
FIGS. 1-3 present the first embodiment of the metal rotary heat transfer assembly according to the present invention in schematic front, side and axonometric view respectively.
Figure 1:
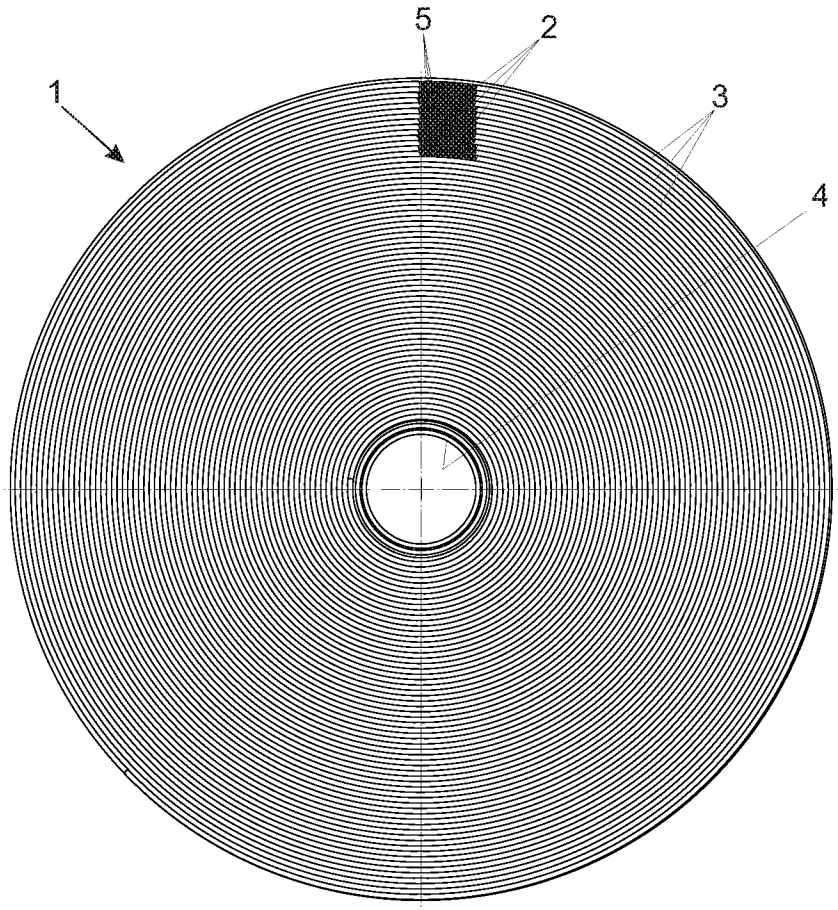
Figure 4:
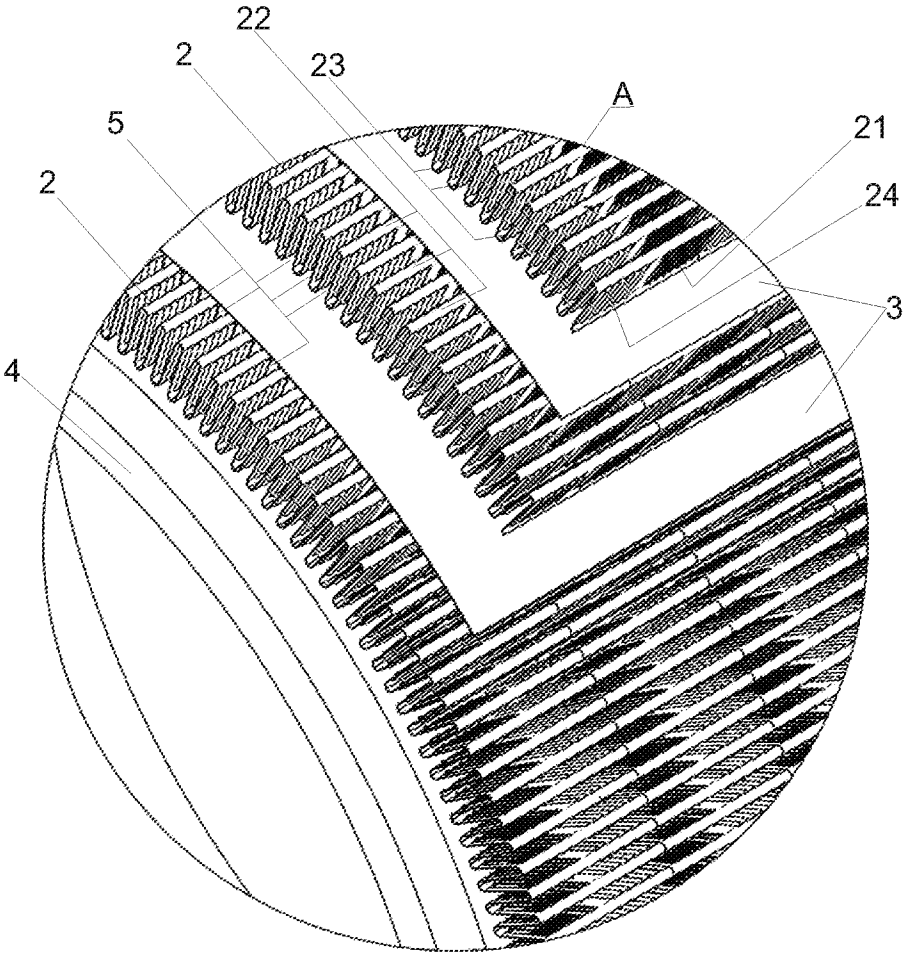
FIG. 4 is an enlarged fragmentary view of the area A from FIG. 3.
Figure 3:
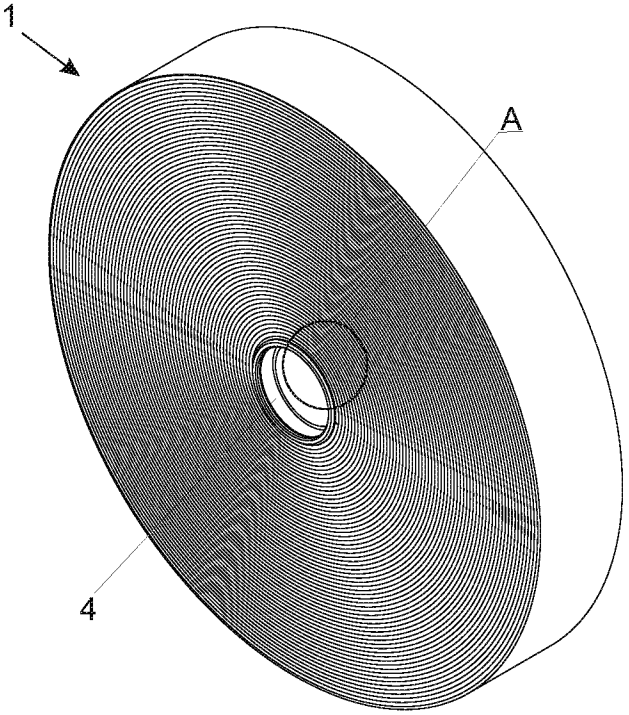
Figure 6:
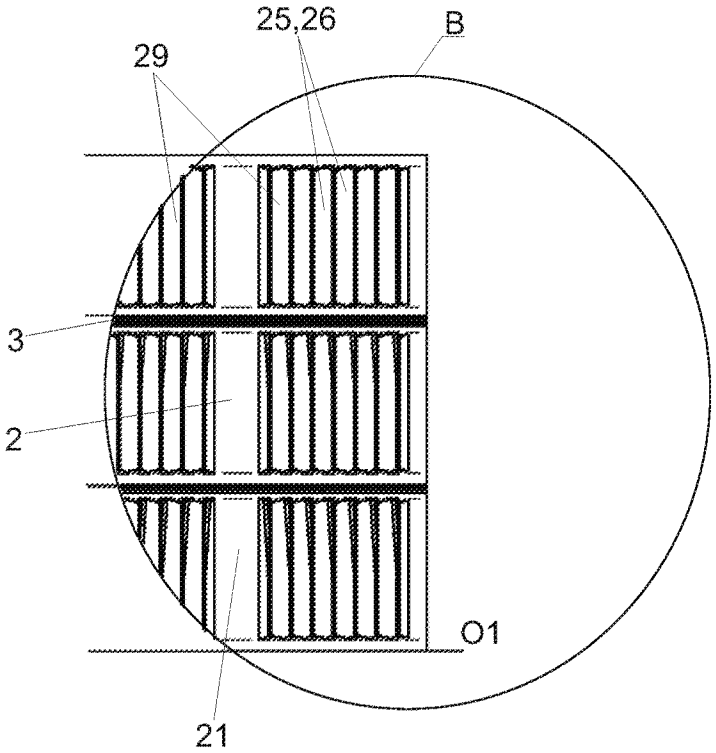
FIG. 6 is an enlarged fragmentary view of the area B from FIG. 5.
Figure 5:
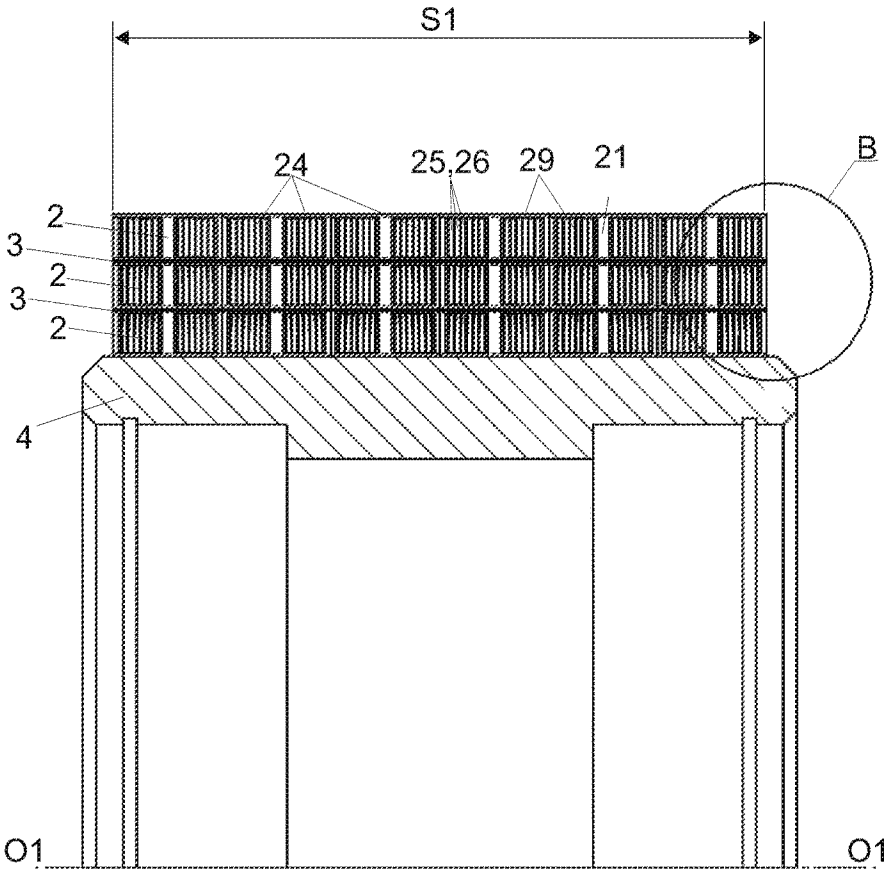
FIG. 5 is a partial longitudinal sectional view of the first embodiment of the rotary heat transfer assembly of the present invention.
Figure 8:
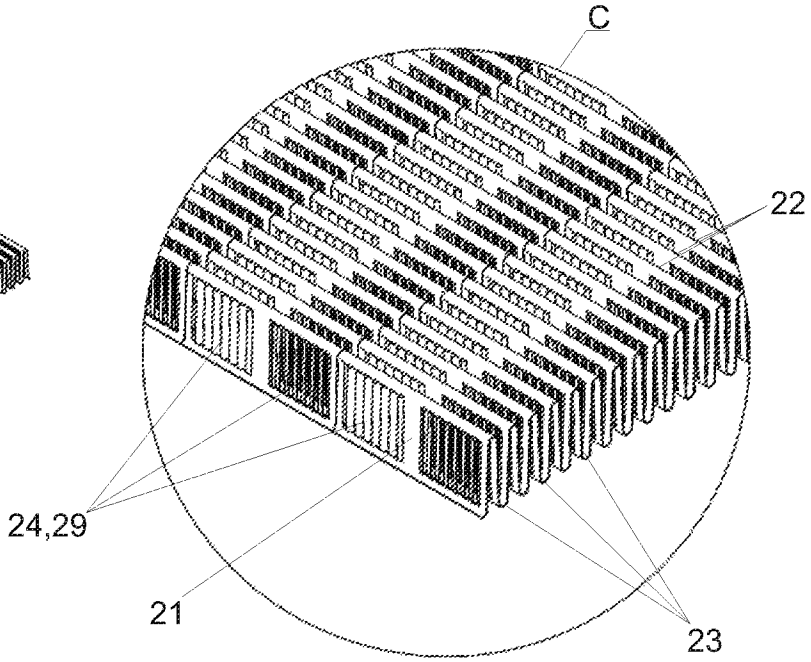
FIG. 8 is an enlarged fragmentary view of the area C from FIG. 7.
Figure 7:
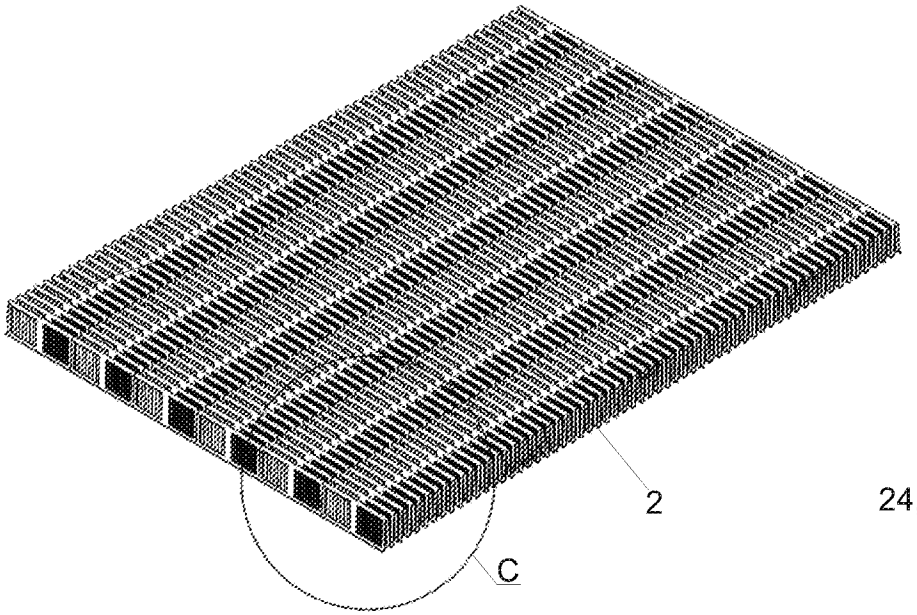
FIG. 7 presents a fragmentary axonometric view of a corrugated metal strip of the rotary heat transfer assembly of FIGS. 1-6.
Figure 11:
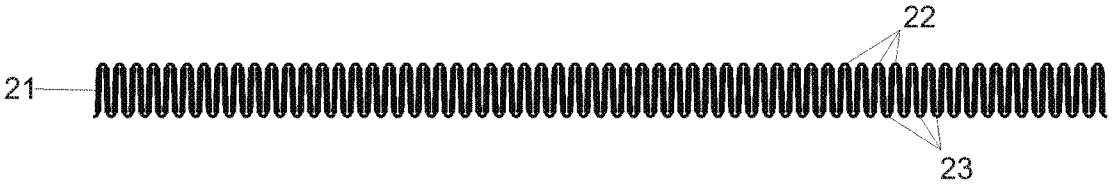
FIGS. 9, 10, 11 present the corrugated metal strip of the rotary heat transfer assembly of FIGS. 1-6 in a state of its planar unwinding in top, side and front view respectively.
Figure 9:
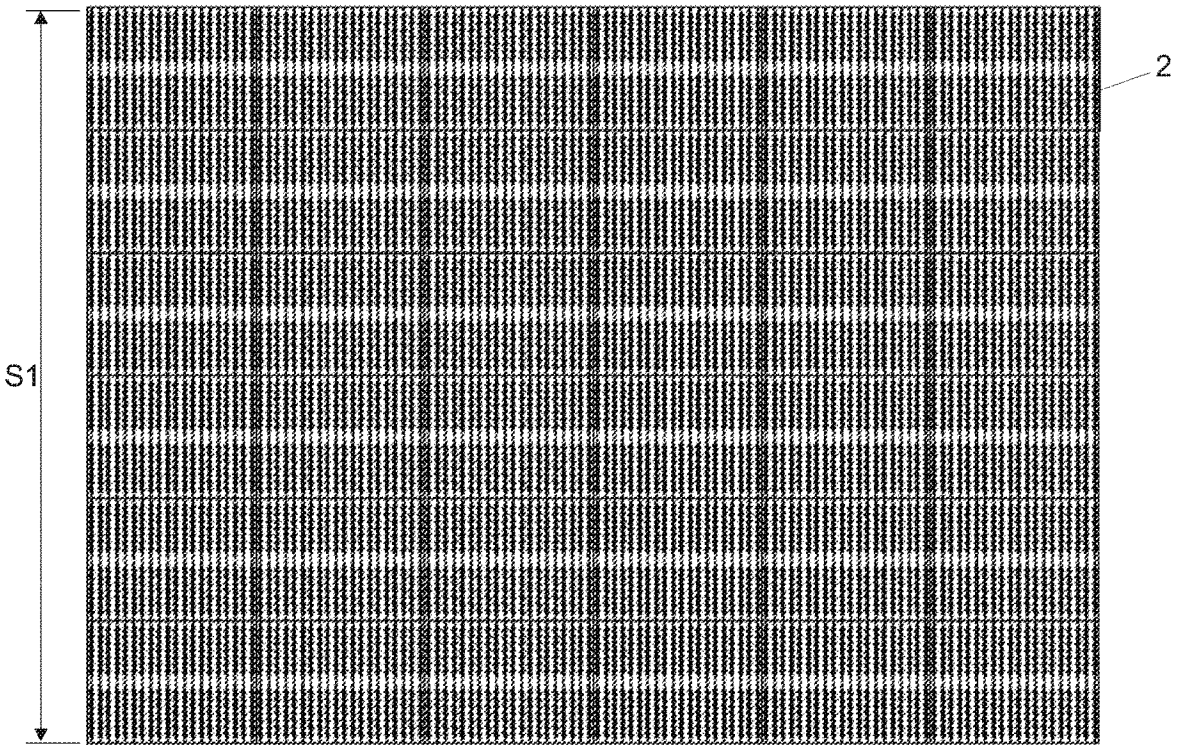
Figure 10:
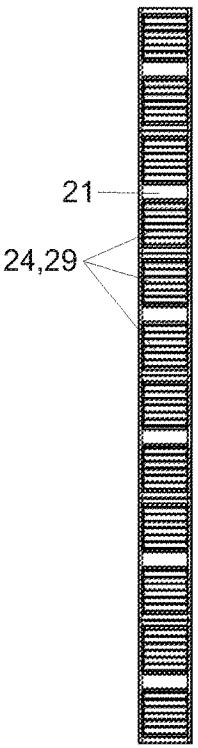
Figure 12:
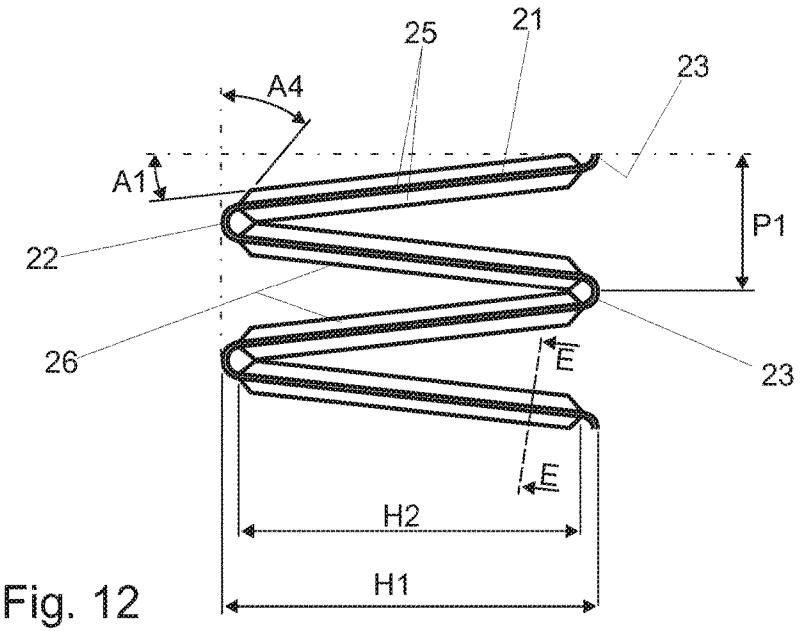
FIG. 12 is an enlarged fragmentary front view of the corrugated metal strip of the rotary heat transfer assembly FIGS. 1-6.

The embodiment of the rotary metal heat transfer assembly 1 according to the present invention as shown in FIGS. 1-13 has a form of a cylinder formed of two thin metal strips (preferably made of aluminium) 2, 3 which are wound spirally on top of each other around the central element 4 such as for example a central hub enabling mounting of the assembly 1 in a rotational manner. The first of the strips is the corrugated metal strip 2 which is corrugated in the circumferential direction of the assembly 1, and the second strip is the metal support flat strip 3. Due to the scale of FIG. 1 and in order not to make FIG. 1 obscure, the corrugated metal strip 2 is made visible only in a relatively small area of the assembly 1, and in FIG. 2 the corrugated metal strip 2 is completely omitted; it is obvious, however, that the corrugated metal strip 2 is disposed between the successive layers of the support flat strip 3, as shown in the enlarged view of FIG. 4.

In a cross-section made in a plane perpendicular to the longitudinal axis O1 of the metal rotary heat transfer assembly 1, the corrugated metal strip 2 comprises corrugation leg portions 21 which are alternately arranged and oppositely inclined with inclination angle A1 and which are interconnected alternately by arcuate corrugation crest portions 22 and arcuate corrugation trough portions 23, wherein the portions 22, 23 have a very large bend curvature and a small bend radius. Therefore the corrugated metal strip 2 may be denoted as a triangularly corrugated strip.

Due to such a spiral multi-layer winding of the strips 2, 3, the strips 2, 3 are arranged alternately in the radial direction of the assembly 1 defining between them a series of transverse through channels 5 passing through said heat transfer assembly 1 in the direction of its longitudinal axis O1.

In the presented embodiment, both the corrugated metal strip 2 and the metal support flat strip 3 are made of composite metal sheets comprising undetachably bonded layers of aluminum alloys, wherein radially outer layers of these sheets are made of alloys with lower melting points than the melting points of their inner layers. According to the present invention, however, such a composite sheet structure of the corrugated metal strip 2 is not necessarily required. In an alternative embodiment of the present invention, only one strip, either the corrugated metal strip 2 or the metal support flat strip 3, may have such a composite structure. In yet another alternative preferred embodiment of the invention, the structures of the sheets of the corrugated metal strip 2 and the metal support flat strip 3 may be such that they make it possible to create a permanent undetachable connection of these strips 2, 3 with each other, for example by means of an adhesive, in particular by means of soldering or gluing.

Both the thickness of the corrugated metal strip 2 and the thickness of the metal support flat strip 3 are in the range of 0.04 mm to 0.20 mm. The corrugation crest portions 22 and the corrugation trough portions 23 of the corrugated metal strip 2 are undetachably connected to the metal support flat strip 3 in the contact areas with the metal support flat strip 3 by soldering to the metal support flat strip 3 by means of the external layers of the strips 2, 3 featuring lower melting points. The corrugated metal strip 2 is characterized by a height H1 and a pitch P1 of its corrugation, wherein the corrugation pitch P1 corresponds to the distance between two adjacent corrugation crest portions 22 or two adjacent corrugation trough portions 23, corresponding in turn to two adjacent corrugation leg portions 21. The height H1 of the corrugated metal strip 2 is preferably in the range of 2 to 20 mm, and the corrugation pitch P1 of the corrugated metal strip 2 is preferably in the range of 2 to 20 mm. The corrugated metal strip belt 2 has the total width S1, which in this embodiment is also the total width of the metal support flat strip 3 and the width of the main body of the metal rotary heat transfer assembly 1.

The rotary metal heat transfer assembly 1 is designed and apt to be installed in a rotational manner in a rotary air heat exchanger (not shown in the drawings) in such a way that a certain part of its frontal surface is crossed in the direction of the longitudinal axis O1 by a stream of warm air that heats the strips 2, 3 by flowing through the transverse through channels 5 and dissipating heat to the strips 2, 3; and a different part of its frontal surface is crossed in the direction of the longitudinal axis O1 by a stream of cold air, which flowing through the transverse through channels 5 gathers heat from the sheets 2, 3 heated by the stream of warm air. Rotation of the rotary metal heat transfer assembly 1 causes the transverse through channels 5 to be periodically moved circumferentially and alternately from the area where a stream of warm air flows through them to the area where a stream of cold air flows through them. Various designs of rotary air heat exchangers are well known in the prior art. Since the essence of the present invention is the rotary metal heat transfer assembly 1 and not the rotary air heat exchanger, the rotary air heat exchanger as such is neither described in detail in this description nor shown in the accompanying drawing.

In order to increase the efficiency of heat transfer between the metal rotary heat transfer assembly 1 and the air streams flowing through it, louvers 24 are formed in the corrugation leg portions 21 of the corrugated metal strip 2, containing a series of pairs 25 of flaps 26 cut in the surfaces of the corrugated metal strips 21 and bent relative to the corrugation leg portions 21 on opposite sides of the corrugation leg portions 21 and oriented oppositely relative to each other in the circumferential direction. As a result of the cutting of flaps 26 in the corrugation leg portions 21 and bending these flaps 26 relative to the corrugation leg portions 21, series of connecting holes 27 are formed in the corrugation leg portions 21, which connect transverse through channels 5 that are adjacent to each other in the circumferential direction. Each flap 26 separates a portion of an air stream flowing through a given transverse through channel 5 and directs such a separated portion of the air flow to the adjacent transverse through channel 5 through the corresponding connecting hole 27. As a result, along the length of the transverse through channel 5 there are successive interruptions of an air stream flowing over the plane of the material of the corrugated metal strip 2 by means of flaps 26 and openings 27, which intensifies the heat exchange between an air stream and the corrugated metal strip 2.

The flaps 26 forming the flap pair 25 are coplanar with respect to each other, and deflection angles A2, A3 of a deflection relative to the surface of the corrugation leg portion 21 for both flaps 26 forming a given flap pair 25 are the same. In alternative embodiments of the present invention not shown in the drawings, it is possible that the deflection angles A2 and A3 are different. According to the present invention, it is preferred that each of the angles A2 and A3 is in the range from 1 to 65°. According to the present invention, the coplanar orientation of the flaps 26 forming one flap pair 25 is not necessarily required. Alternatively, the flaps 26 in one flap pair 25 may for example have an offset relative to each other with their planes aligned in parallel, or may have an offset relative to each other and additionally may be non-parallel with respect to each other.

The flaps 25 forming a flap pair 25 are connected to the corrugation leg portions 21 along the bending edges 28 extending perpendicularly to the longitudinal axis O1 of the rotary metal heat transfer assembly 1. In alternative preferred embodiments of the present invention that are not shown in the drawings, the bending edges 28 do not have to be necessarily perpendicular to the longitudinal axis O1 of the rotary metal heat transfer assembly 1, but they may extend slantwise relative to the longitudinal axis O1. According to the present invention the orientation of the bending edges 28 is not essentially a critical feature; however, according to the present invention, it is preferred that these bending edges 28 extend non-parallel to the longitudinal axis O1 of the rotary metal heat transfer assembly 1.

The flaps 26 have a height H2 that is smaller than the height H1. The side edge of the flap 26 is inclined at an angle A4 relative to a plane formed by the tops of the corrugation crest portions 22 or the tops the corrugation trough portions 23 of planarly unwound corrugated metal strip 2. The inclination angle A4 is preferably in the range of 4 to 65°.

The projection of a pair 25 of flaps 26 on a plane perpendicular to the corrugation leg portion 21 of the corrugated metal strip 2 along the longitudinal axis O1 of the rotary metal heat transfer assembly 1 has the width S2.

Figure 13:
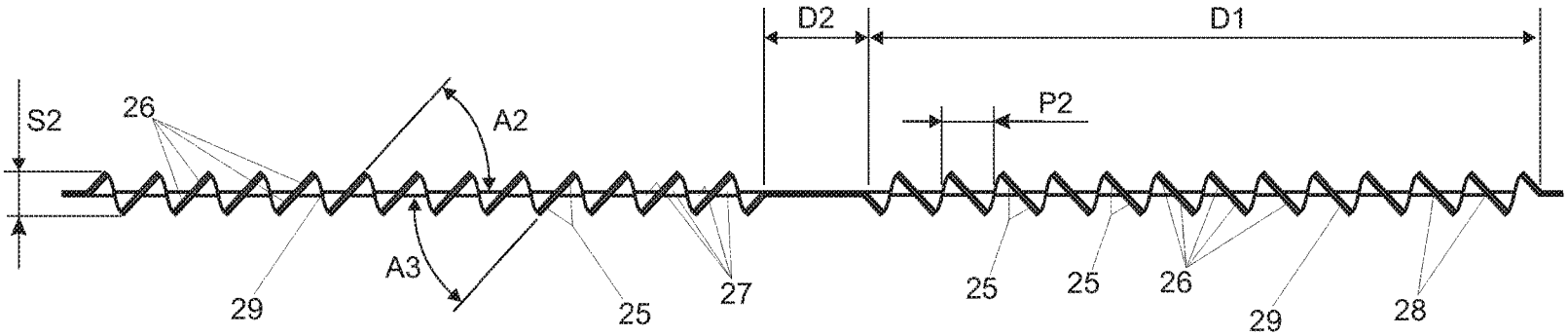
FIG. 13 presents a fragmentary cross-sectional view taken along the line E-E depicted in FIG. 12.
Figure 15:
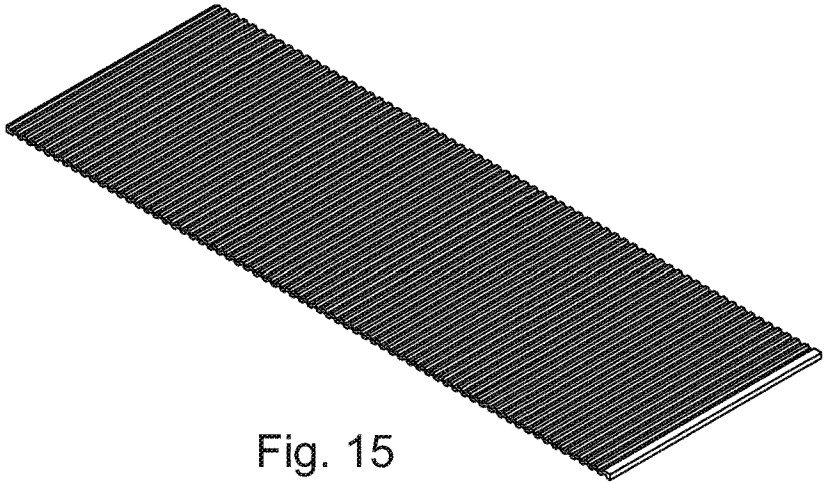
Figure 16:
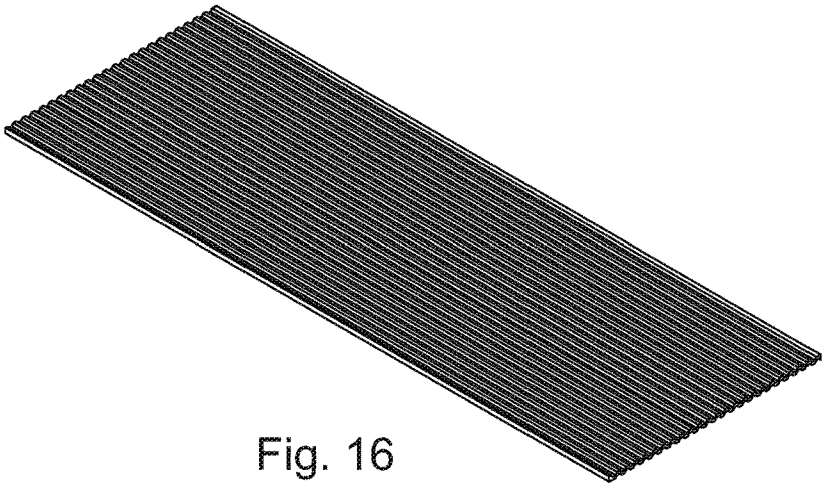

The pitch P2 of the louver 24 is defined according to the present invention as a distance between corresponding points of adjacent pairs 25 of flaps 26 (for example the distance between the bending edges 28 of adjacent pairs 25 of flaps 26 as shown in FIG. 13). The pitch P2 is preferably in the range of 0.4 to 12 mm.

In the presented embodiment, pairs 25 of the flaps 26 are grouped into subsets 29 of a length D1. The length D1 of the subset 29 amounts preferably from 5 to 50% of the total width S1 of the corrugated metal strip 2. The flaps 26 of adjacent subsets 29 which correspond to each other in the adjacent subsets 29 have opposite inclinations relative to the corrugation leg portions 21. The adjacent subsets 29 are distanced from each other by a distance D2. The distance D2 between adjacent subsets 29 amounts preferably from 2 to 20 mm.

Figure 14:
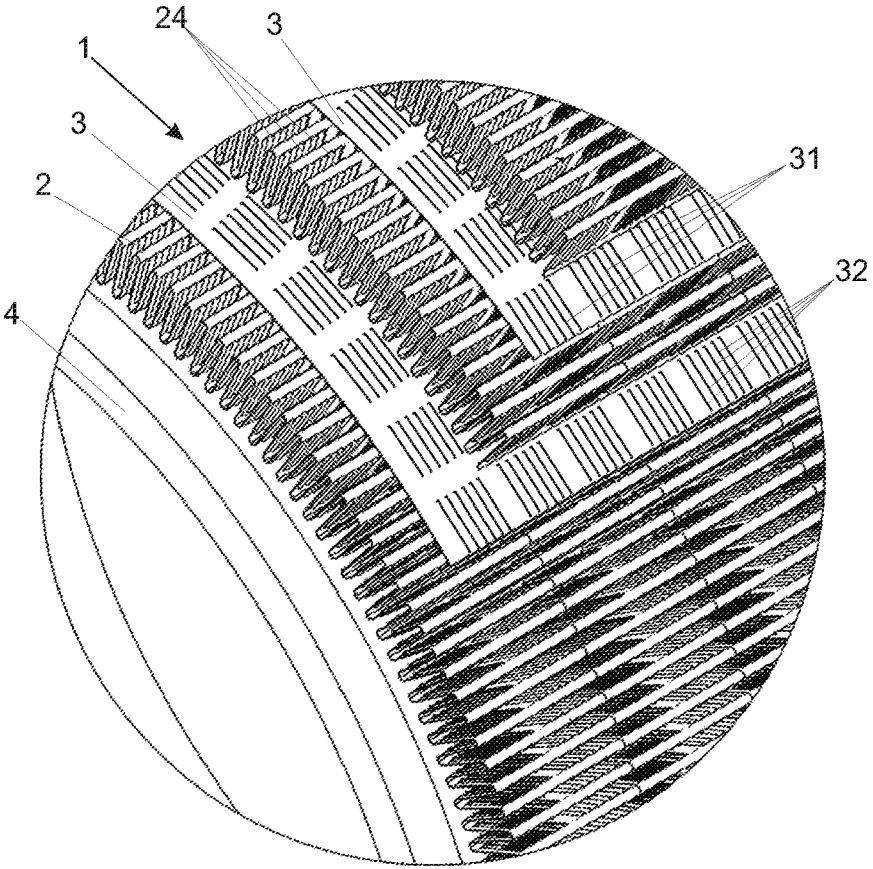
FIG. 14 depicts an enlarged fragmentary view of another embodiment of the rotary heat transfer assembly of the present invention in a manner similar as FIG. 4.

FIG. 14 depicts another preferred embodiment of the metal rotary heat transfer assembly 1 according to the present invention in which also the metal support flat strip 3 is provided with louvers 31 comprising a series of flaps 32 that additionally increase the efficiency of heat transfer between the metal rotary heat transfer assembly 1 and the air streams flowing through it.

FIGS. 15-20 depict some preferred types of metal sheets with specifically deformed surfaces which the corrugated metal strips and metal support flat strips of the rotary metal heat transfer assembly according to the present invention are advantageously made of.

Figure 17:
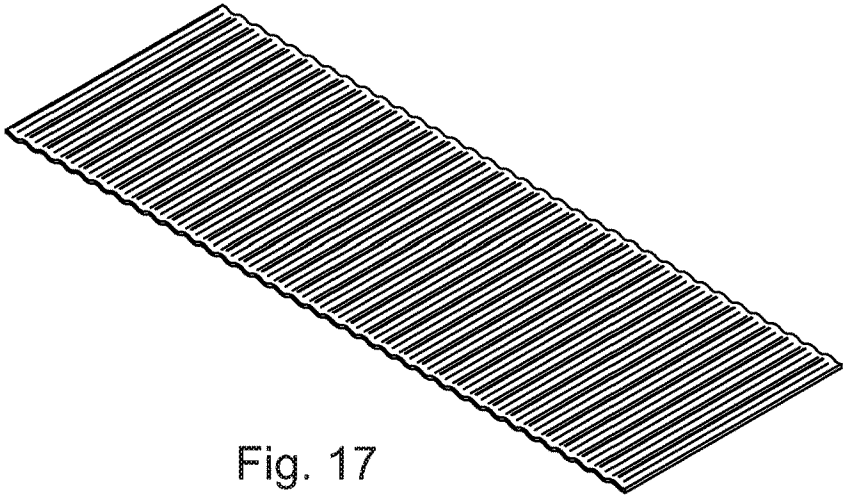
Figure 18:
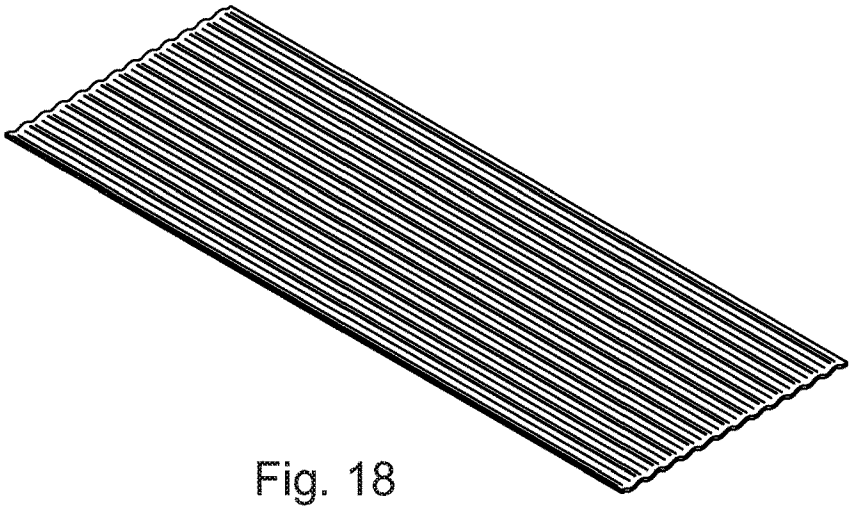

The first four such preferred types of metal sheets are transversely and longitudinally trapezoidally micro-corrugated metal sheets (FIGS. 15, 16) and transversely and longitudinally and sinusoidally micro-corrugated metal sheets (FIGS. 17, 18).

Figure 19:
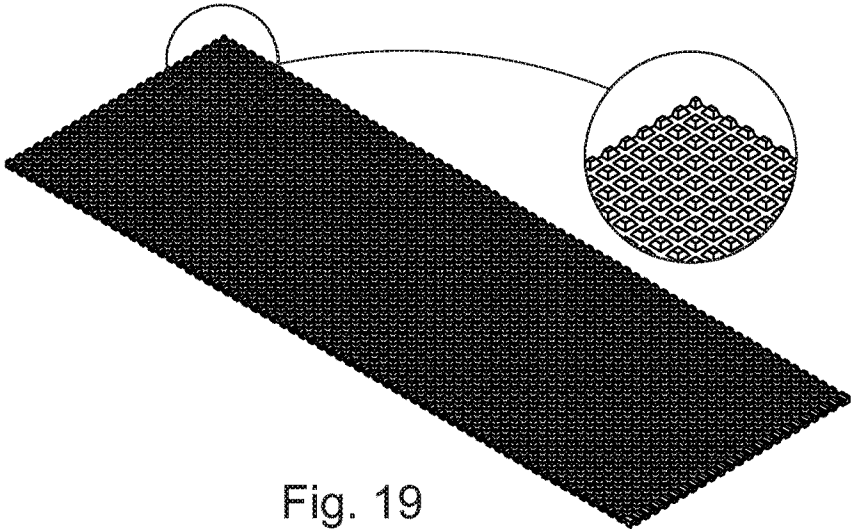
Figure 20:
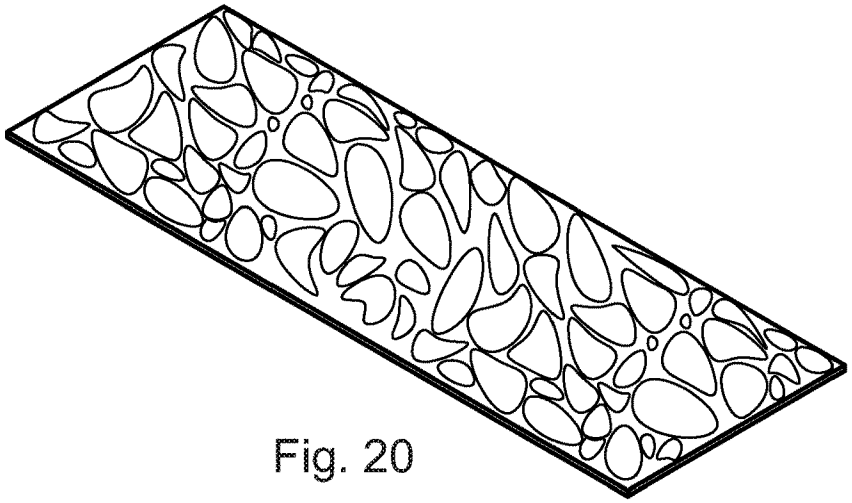

The metal sheet depicted in FIG. 19 has an array of a number of pyramidal micro-protrusions formed on its surfaces, and the metal sheet depicted in FIG. 20 has a number of flat micro-protrusions of different shapes and sizes formed on surfaces thereof.

Such micro-deformations of the surfaces of the corrugated metal strips and metal support flat strips preferably penetrate into the material of the strips to a depth amounting approximately 30% of the strip thickness.

Such micro-deformations, micro-corrugations, micro-projections and other types of micro-roughness formed on the surfaces of the corrugated metal strips and metal support flat strips of the rotary metal heat transfer assembly according to the present invention advantageously improve moisture transfer by a rotary air heat exchanger provided with the rotary metal heat transfer assembly of the present invention.

Formation of such micro-deformations/micro-roughness of metal sheets used for producing the corrugated metal strips and metal support flat strips of the rotary metal heat transfer assembly according to the present invention may be carried out in any suitable manner, such as for example a rolling process.

Although in the above-described embodiments the corrugated metal strip is triangularly corrugated, it is obvious to those skilled in the art that the present invention may be implemented and practiced with any other types of corrugated metal strips in which the louvers of the present invention are formed on the corrugation leg portions. In particular, in other preferable embodiments of the rotary metal heat transfer assembly according to the present invention, that are not shown in the drawings, trapezoidally corrugated, or rectangularly corrugated or sinusoidally corrugated strips having louvers according to the present invention formed on their corrugation leg portions.

The presented embodiments and the attached drawings should not be regarded as limiting the scope of protection of the present invention which is defined in the appended patent claims. It is obvious to those skilled in the art that many other variations and modifications of the present invention different from the above-described embodiments can be made, including new variations that are combinations of the above-described embodiments. The above-described embodiments of the present invention are merely exemplary. The figures are not necessarily to scale and some features may be exaggerated or minimized in order to better illustrate the present invention. These and other factors however should not be considered as limiting the present invention.

LIST OF REFERENCE NUMERALS

1 rotary metal heat transfer assembly
2 corrugated metal strip 2
  21 corrugation leg portion
  22 corrugation crest portion
  23 corrugation trough portion
  24 louver
  25 pair of flaps
  26 flap
  27 connecting hole
  28 bending edge
  29 subset of pairs 25 of flaps 26
3 metal support flat strip
  31 louver
  32 flap
4 central element
5 transverse through channel
O1 longitudinal axis of the rotary metal heat transfer assembly 1
S1 total width of the corrugated metal strip 2
S2 width of a pair 25 of the flaps 26
P1 corrugation pitch of the corrugated metal strip 2
P2 pitch 24 of the louver 24
A1 inclination angle of the corrugation leg portion 21
A2, A3 deflection angle of the flaps 26 of the louver 24
A4 inclination angle of side edge of the flap 26
D1 length of the subset 29
D2 distance between adjacent subsets 29

The invention claimed is:

1. A metal rotary heat transfer assembly for a rotary air heat exchanger comprising a corrugated metal strip and a metal support flat strip wound spirally in the circumferential direction and alternately in the radial direction on a central element, wherein the corrugated metal strip is corrugated in the circumferential direction, and wherein in a cross-section made in a plane perpendicular to the longitudinal axis of the assembly said corrugated metal strip comprises a set of corrugation leg portions interconnected alternately by corrugation crest portions and corrugation trough portions, and wherein a plurality of transverse through channels passing through said metal rotary heat transfer assembly in the direction of its longitudinal axis is defined between the corrugated metal strip and the metal support flat strip, wherein, louvers are formed in the corrugation leg portions of the corrugated metal strip, and the louvers comprise a series of pairs of flaps cut in the surfaces of the corrugation leg portions and defining a series of connecting holes in the corrugation leg portions, wherein in each flap pair the flaps are bent relative to the corrugation leg portion on opposite sides of the corrugation leg portion and oriented oppositely relative to each other in the circumferential direction.

2. The metal rotary heat transfer assembly according to claim 1, wherein the corrugated metal strip is triangularly corrugated, or trapezoidally corrugated, or rectangularly corrugated or sinusoidally corrugated.

3. The metal rotary heat transfer assembly according to claim 1, characterized in that, wherein the flaps forming a pair of flaps are coplanar with each other.

4. The metal rotary heat transfer assembly according to claim 1, wherein deflection angles of a deflection relative to the surface of the corrugation leg portion for both flaps forming a pair of flaps are the same.

5. The metal rotary heat transfer assembly according to any, claim 1, wherein the corrugation crest portion and the corrugation trough portion of the corrugated metal strip are undetachably connected to the metal support flat strip in the contact areas with the metal support flat strip, preferably by means of an adhesive, and even more preferably they are soldered or glued to the metal support flat strip.

6. The metal rotary heat transfer assembly according to claim 5, wherein the corrugated metal strip and/or the metal support flat strip is/are covered with a layer of solder cladding, and/or is/are made of a composite metal sheet comprising at least two undetachably bonded layers of aluminum alloys, wherein radially outer layers of this sheet are made of alloys with lower melting points than the melting points of its inner layers.

7. The metal rotary heat transfer assembly according to any claim 1, wherein the height of the corrugated metal strip amounts at least 2 mm, and preferably from 2 to 20 mm.

8. The metal rotary heat transfer assembly according to any claim 1, wherein the corrugation pitch of the corrugated metal strip, corresponding to the distance between two adjacent corrugation crest portions or two adjacent corrugation trough portions, corresponding in turn to two adjacent corrugation leg portions, amounts from 2 to 20 mm.

9. The metal rotary heat transfer assembly according to any claim 1, wherein the thickness of the corrugated metal strip amounts from 0.04 to 0.20 mm and/or the thickness of the metal support flat strip amounts from 0.04 to 0.20 mm.

10. The metal rotary heat transfer assembly claim 1, wherein the flaps forming the louver are connected to the corrugation leg portions along bending edges oriented non-parallel relative to the longitudinal axis of the rotary metal heat transfer assembly, and preferably they are oriented perpendicularly relative to the longitudinal axis of the rotary metal heat transfer assembly.

11. The metal rotary heat transfer assembly according to claim 1, wherein the pitch of the louver amounts from 0.4 to 12 mm.

12. The metal rotary heat transfer assembly according to claim 1, wherein deflection angle of the flaps of the louver amounts from 1 to 65°.

13. The metal rotary heat transfer assembly according to claim 1, wherein the pairs of the flaps of the louvers are grouped in subsets having a length constituting from 5 to 50% of the total length of the corrugated metal strip, wherein adjacent subsets are distanced from each other by a distance amounting from 2 to 20 mm, and wherein the flaps of adjacent subsets which correspond to each other in the adjacent subsets have opposite inclinations relative to the corrugation leg portions.

14. The metal rotary heat transfer assembly according to claim 1, wherein the metal support flat strip is provided with louvers comprising a series of flaps.

15. The metal rotary heat transfer assembly according to claim 1, wherein the corrugated metal strip and/or the metal support flat strip have/has micro-deformations, micro-corrugations, micro-projections and/or micro-roughness formed on surfaces thereof and preferably penetrating into the material of the strip to a depth amounting approximately 30% of the strip thickness.

* * * * *